US005875520A

United States Patent [19]

Chang

[11] Patent Number: 5,875,520

[45] Date of Patent: Mar. 2, 1999

[54] EXTENSIBLE HANDLE DEVICE

[76] Inventor: Wen-Chen Chang, 58, Ma Yuan West St., Taichung, Taiwan

[21] Appl. No.: 950,714

[22] Filed: Oct. 15, 1997

[51] Int. Cl.[6] ..... A47B 95/02

[52] U.S. Cl. ..... 16/115; 280/655

[58] Field of Search ..... 16/115; 190/15.1, 190/18 A, 115; 280/655, 655.1, 47.31, 47.315

[56] References Cited

U.S. PATENT DOCUMENTS 5,620,070 4/1997 Wang ..... 16/115
5,628,088 5/1997 Chen ..... 16/115
5,692,266 12/1997 Tsai ..... 16/115
5,704,725 1/1998 Horing ..... 16/115

*Primary Examiner*—Chuck Y. Mah

[57] ABSTRACT

An extensible handle device has a wheel support seat, a positioning seat, two outer pipes inserted in the wheel support seat and the positioning seat, two inner pipes inserted in the outer pipes, two base seats inserted in the inner pipes, two U-shaped slide seats inserted in the base seats, two drive blocks disposed on the base seats, a grip, a press button disposed in the grip, two hollow arm bars connected to the press button, a protruded bar disposed on a bottom of the press button, and two rods inserted in the hollow arm bars and the drive blocks. A coiled spring surrounds the drive block. The protruded bar is surrounded by a compression spring.

1 Claim, 6 Drawing Sheets

EXTENSIBLE HANDLE DEVICE

BACKGROUND OF THE INVENTION

The present invention relates to an extensible handle device. More particularly, the present invention relates to an extensible handle device for a suitcase.

A conventional handle device of a suitcase can be extended or retracted. However, the positioning device may not position the conventional handle device stably after the conventional handle device is extended or retracted. After a long period of usage, the positioning device may be worn out. Furthermore, the springs of the positioning device may lose its elasticity to decrease the function of the positioning device.

SUMMARY OF THE INVENTION

An object of the present invention is to provide an extensible handle device which can be positioned in a suitcase stably.

In accordance with a first embodiment of the present invention, an extensible handle device comprises a wheel support seat, two outer pipes, two inner pipes, two base seats, two U-shaped slide seats, two drive blocks, two rods, a press button, a grip, and a positioning seat. The wheel support seat has two hollow sleeves. Each of the outer pipes has a plurality of positioning holes. Each of the hollow sleeves receives the respective outer pipe. The positioning seat has two square holes and two enlarged holes. Each of the square holes communicates with the respective enlarged hole. Each of the inner pipes has a through hole. The grip has an upper slot and two bottom round holes. Two hollow arm bars are connected to the press button. A protruded bar is disposed on a bottom of the press button. Each of the base seats has a base plate, a main body, a hollow interior formed in the main body, two upper lobes disposed on the main body, a channel defined between the upper lobes, the channel communicating with the hollow interior, and a circular hole formed in the main body. Each of the U-shaped slide seats has a cylinder column and two lateral grooves. Each of the drive blocks has a middle plate, a hollow pillar disposed on the middle plate, a post disposed on a bottom of the middle plate, and a crossbar disposed on the post. Each of the rods is inserted in the respective hollow arm bar and the respective hollow pillar. Each of the inner pipes is inserted in the respective outer pipe. Each of the base seats is inserted in the respective inner pipe. Each of the slide seats is inserted in the respective hollow interior. Each of the posts is enclosed by a coiled spring. Each of the crossbars is inserted in the respective lateral grooves. Each of the enlarged holes receives the respective outer pipe. Each of the bottom round holes receives the respective inner pipe. The arm bars are disposed in the grip. The press button is inserted in the slot. The protruded bar is surrounded by a compression spring. Each of the cylinder columns is inserted through the respective circular hole and the respective through hole.

In accordance with a second embodiment of the present invention, an extensible handle device comprises a wheel support seat, two outer pipes, two inner pipes, two base seats, two U-shaped slide seats, two drive blocks, two rods, a press button, a grip, and a positioning seat. The wheel support seat has two hollow sleeves. Each of the outer pipes has a plurality of positioning holes. Each of the hollow sleeves receives the respective outer pipe. The positioning seat has two square holes and two enlarged holes. Each of the square holes communicates with the respective enlarged hole. Each of the inner pipes has a through hole. The grip has a bottom slot and two bottom round holes. Two hollow arm bars are connected to the press button. A protruded bar is disposed on a top portion of the press button. Each of the base seats has a base plate, a main body, a hollow interior formed in the main body, two upper lobes disposed on the main body, a channel defined between the upper lobes, the channel communicating with the hollow interior, and a circular hole formed in the main body. Each of the U-shaped slide seats has a cylinder column and two lateral grooves. Each of the drive blocks has a middle plate, a hollow pillar disposed on the middle plate, a post disposed on a bottom of the middle plate, and a crossbar disposed on the post. Each of the rods is inserted in the respective hollow arm bar and the respective hollow pillar. Each of the inner pipes is inserted in the respective outer pipe. Each of the base seats is inserted in the respective inner pipe. Each of the slide seats is inserted in the respective hollow interior. Each of the posts is enclosed by a coiled spring. Each of the crossbars is inserted in the respective lateral grooves. Each of the enlarged holes receives the respective outer pipe. Each of the bottom round holes receives the respective inner pipe. The arm bars are disposed in the grip. The press button is inserted in the slot. The protruded bar is surrounded by a compression spring. Each of the cylinder columns is inserted through the respective circular hole and the respective through hole.

DETAILED DESCRIPTION OF THE INVENTION

Figure 1:
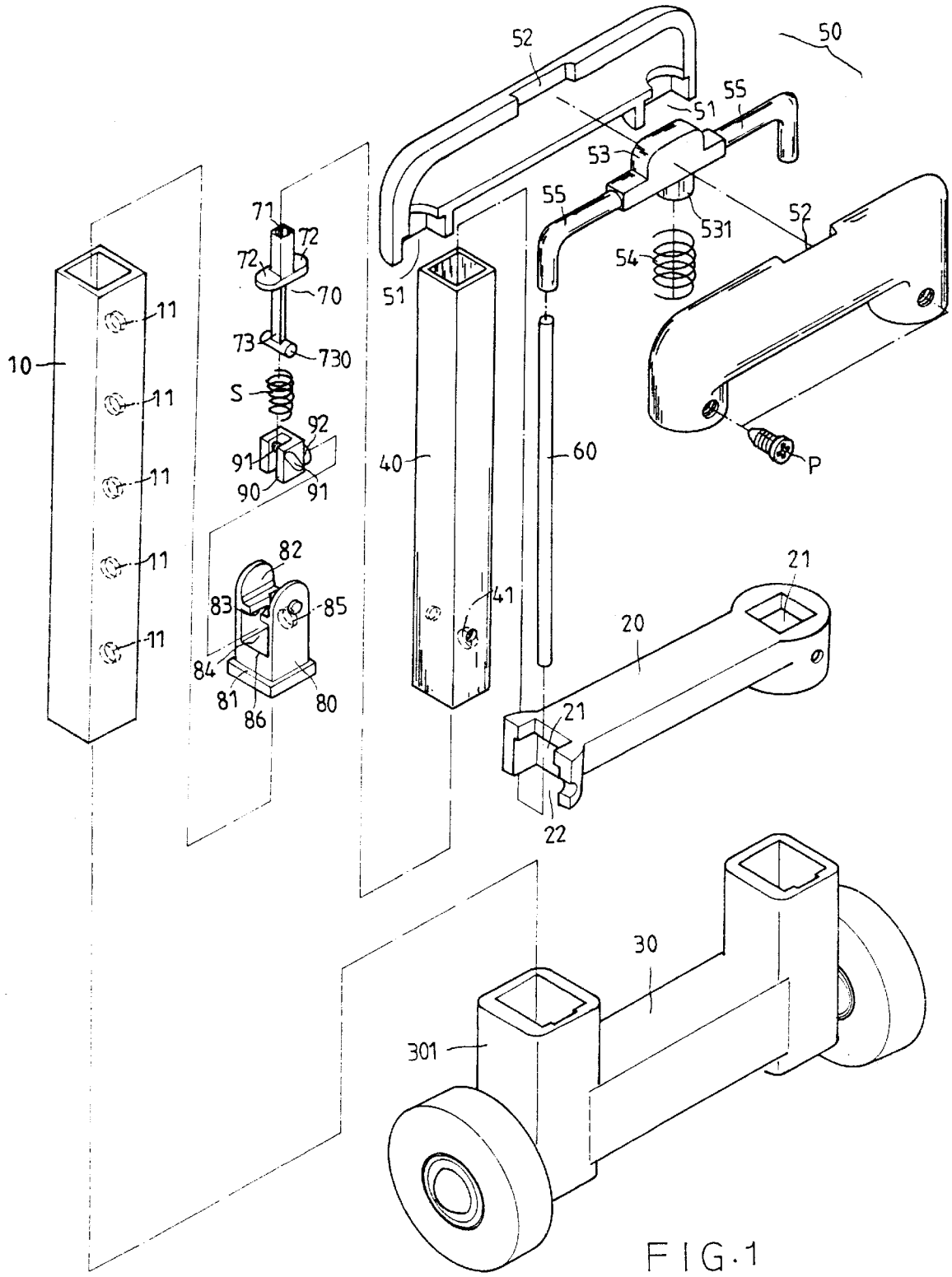
FIG. 1 is a perspective exploded view of an extensible handle device of a first preferred embodiment in accordance with the present invention.
Figure 2:
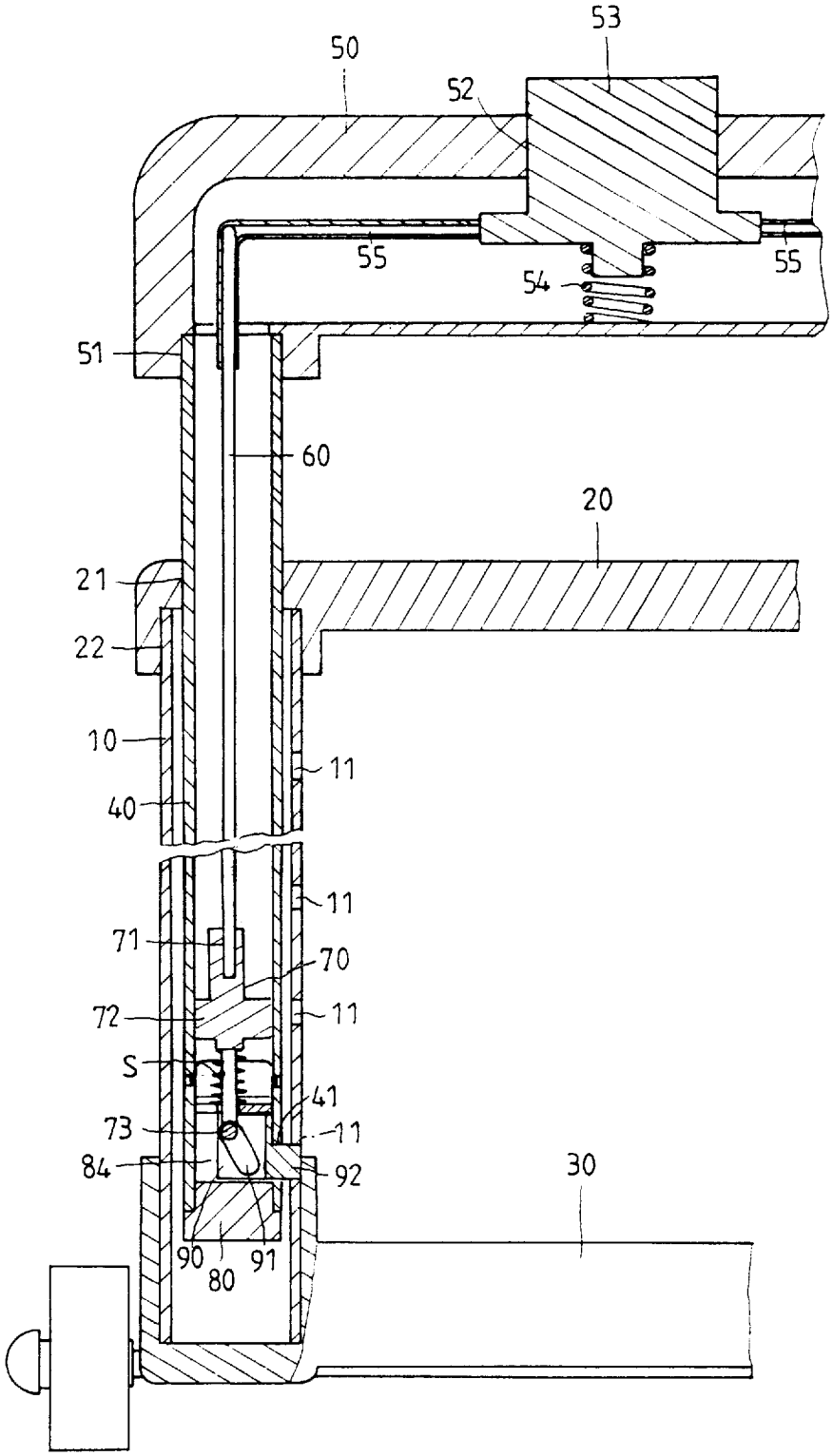
FIG. 2 is a sectional schematic view illustrating an operation of an extensible handle device of a first preferred embodiment while a press button is not pressed.

Referring to FIGS. 1 and 2, an extensible handle device comprises a wheel support seat 30, two outer pipes 10, two inner pipes 40, two base seats 80, two U-shaped slide seats 90, two drive blocks 70, two rods 60, a press button 53, a grip 50, and a positioning seat 20. The wheel support seat 30 has two hollow sleeves 301. Each of the outer pipes 10 has a plurality of positioning holes 11. Each of the hollow sleeves 301 receives the respective outer pipe 10. The positioning seat 20 has two square holes 21 and two enlarged holes 22. Each of the square holes 21 communicates with the respective enlarged hole 22. Each of the inner pipes 40 has a through hole 41. The grip 50 has an upper slot 52 and two bottom round holes 51. Two hollow arm bars 55 are connected to the press button 53. A protruded bar 531 is disposed on a bottom of the press button 53. Each of the base seats 80 has a base plate 81, a main body 86, a hollow interior 84 formed in the main body 86, two upper lobes 82 disposed on the main body 86, a channel 83 defined between the upper lobes 82, the channel 83 communicating with the hollow interior 84, and a circular hole 85 formed in the main body 86. Each of the U-shaped slide seats 90 has a cylinder column 92 and two lateral grooves 91. Each of the drive blocks 70 has a middle plate 72, a hollow pillar 71 disposed on the middle plate 72, a post 73 disposed on a bottom of the middle plate 72, and a crossbar 730 disposed on the post 73. Each of the rods 60 is inserted in the respective hollow arm bar 55 and the respective hollow pillar 71. Each of the inner pipes 40 is inserted in the respective outer pipe 10. Each of the base seats 80 is inserted in the respective inner pipe 40. Each of the slide seats 90 is inserted in the respective hollow interior 84. Each of the posts 73 is enclosed by a coiled spring S. Each of the crossbars 730 is inserted in the respective lateral grooves 91. Each of the enlarged holes 22 receives the respective outer pipe 10. Each of the bottom round holes 51 receives the respective inner pipe 40. The arm bars 55 are disposed in the grip 50. The press button 53 is inserted in the slot 52. The protruded bar 531 is surrounded by a compression spring 54. Each of the cylinder columns 92 is inserted through the respective circular hole 85, the respective through hole 41, and one of the positioning holes 11. Two rivets P fasten the grip 50.

Figure 3:
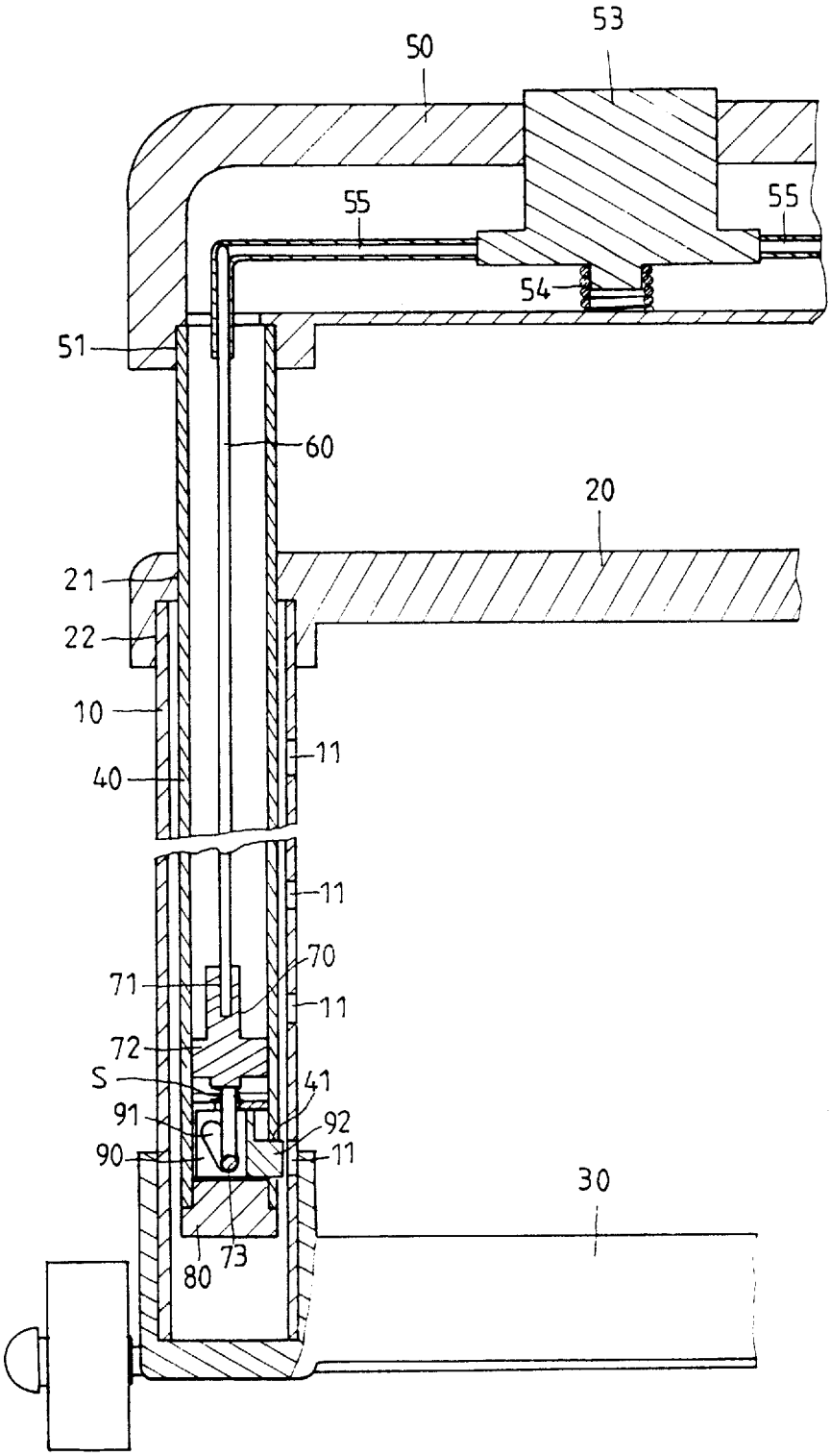
FIG. 3 is a sectional schematic view illustrating an operation of an extensible handle device of a first preferred embodiment while a press button is pressed.

Referring to FIG. 3, the press button 53 is pressed downward. Then the drive blocks 70 move downward. The crossbars 730 move along the lateral grooves 91. Then the cylinder columns 92 disengage from the positioning holes 11. Therefore, the user can adjust the length of the extensible handle device.

Figure 4:
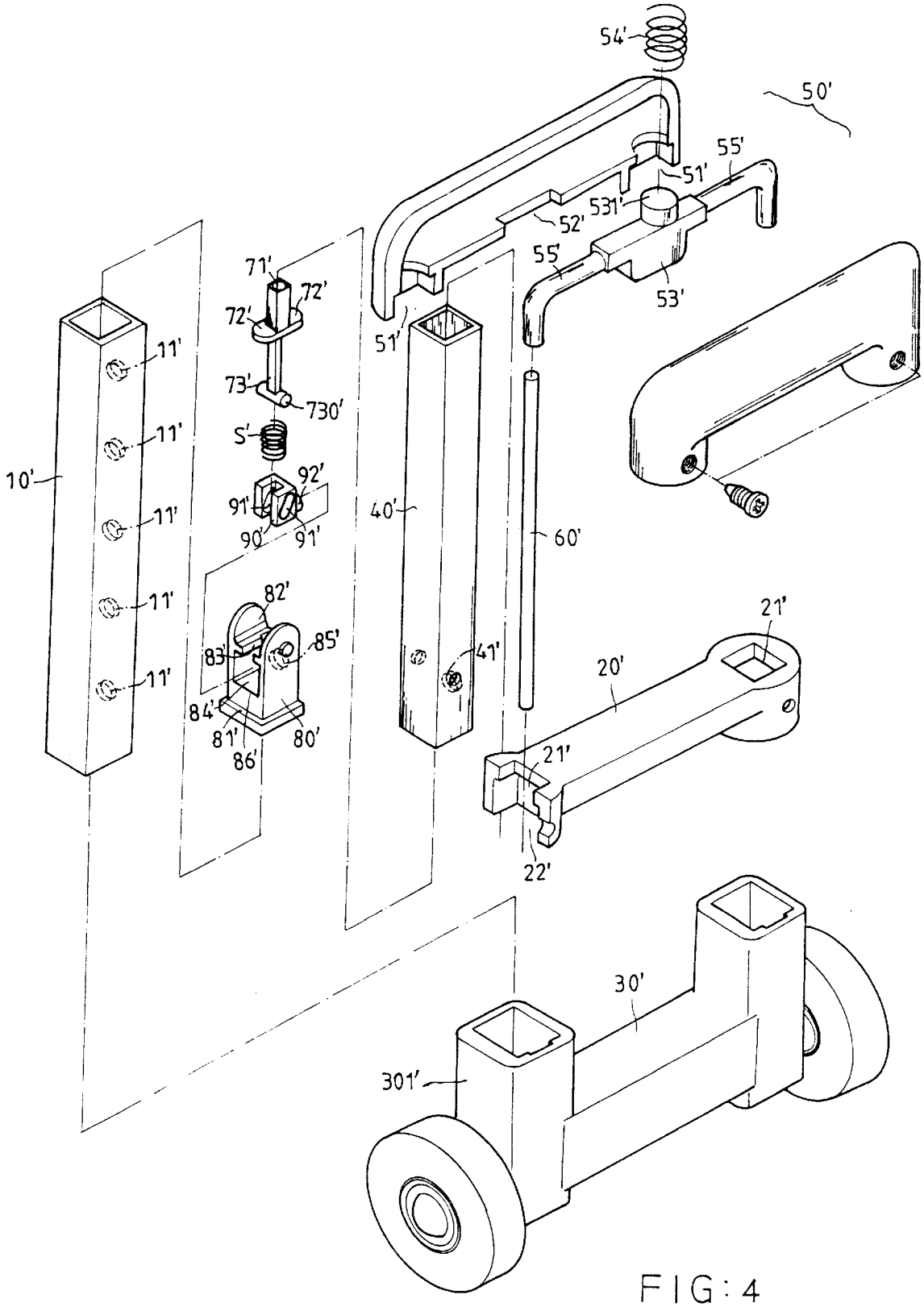
FIG. 4 is a perspective exploded view of an extensible handle device of a second preferred embodiment in accordance with the present invention.
Figure 5:
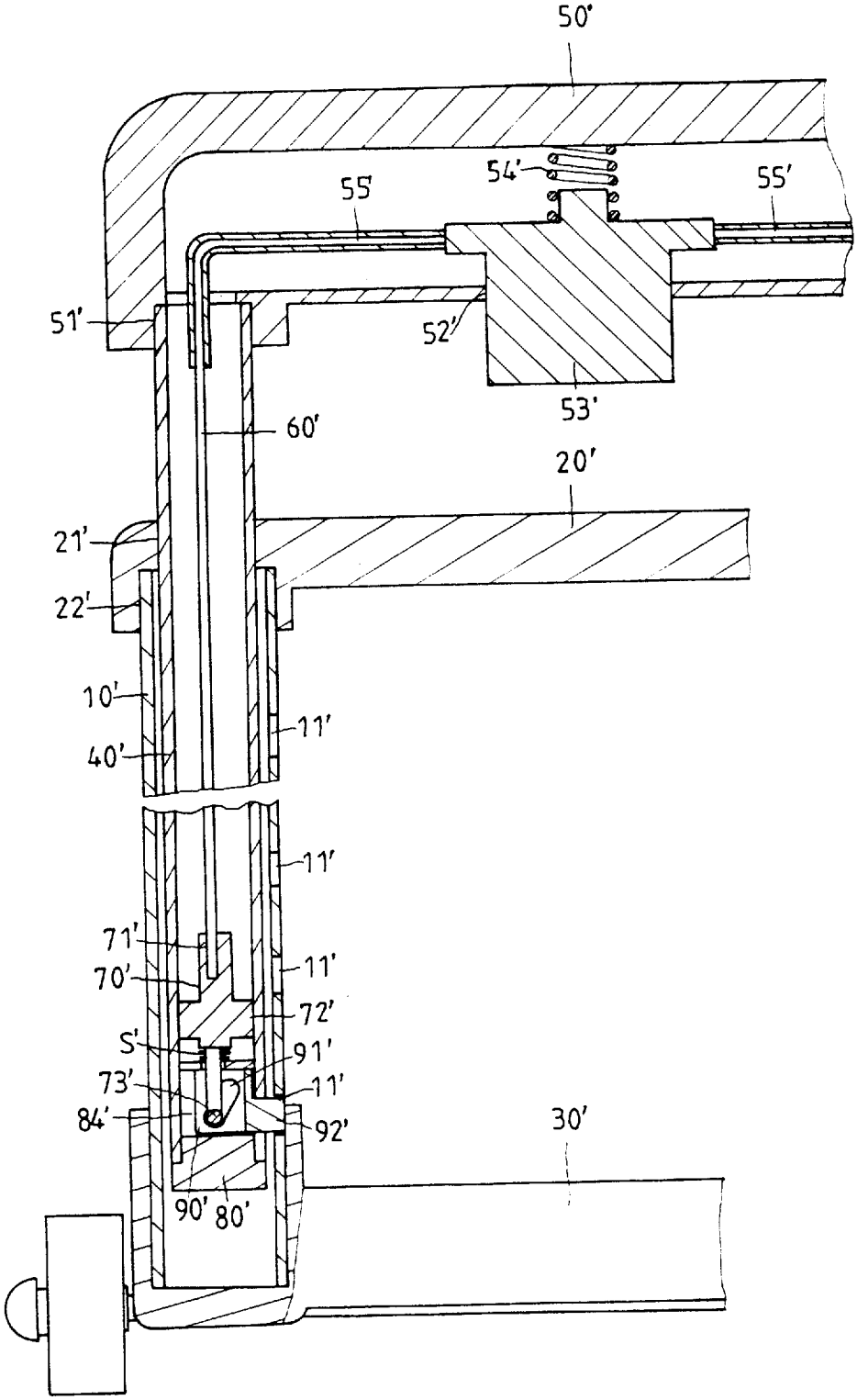
FIG. 5 is a sectional schematic view illustrating an operation of an extensible handle device of a second preferred embodiment while a press button is not pressed.

Referring to FIGS. 4 and 5, another extensible handle device comprises a wheel support seat 30', two outer pipes 10', two inner pipes 40', two base seats 80', two U-shaped slide seats 90', two drive blocks 70', two rods 60', a press button 53', a grip 50', and a positioning seat 20'. The wheel support seat 30' has two hollow sleeves 301'. Each of the outer pipes 10' has a plurality of positioning holes 11'. Each of the hollow sleeves 301' receives the respective outer pipe 10'. The positioning seat 20' has two square holes 21' and two enlarged holes 22'. Each of the square holes 21' communicates with the respective enlarged hole 22'. Each of the inner pipes 40' has a through hole 41'. The grip 50' has a bottom slot 52' and two bottom round holes 51'. Two hollow arm bars 55' are connected to the press button 53'. A protruded bar 531' is disposed on a top portion of the press button 53'. Each of the base seats 80' has a base plate 81', a main body 86', a hollow interior 84' formed in the main body 86', two upper lobes 82' disposed on the main body 86', a channel 83' defined between the upper lobes 82', the channel 83' communicating with the hollow interior 84', and a circular hole 85' formed in the main body 86'. Each of the U-shaped slide seats 90' has a cylinder column 92' and two lateral grooves 91'. Each of the drive blocks 70' has a middle plate 72', a hollow pillar 71' disposed on the middle plate 72', a post 73' disposed on a bottom of the middle plate 72', and a crossbar 730' disposed on the post 73'. Each of the rods 60' is inserted in the respective hollow arm bar 55' and the respective hollow pillar 71'. Each of the inner pipes 40' is inserted in the respective outer pipe 10'. Each of the base seats 80' is inserted in the respective inner pipe 40'. Each of the slide seats 90' is inserted in the respective hollow interior 84'. Each of the posts 73' is enclosed by a coiled spring S'. Each of the crossbars 730' is inserted in the respective lateral grooves 91'. Each of the enlarged holes 22' receives the respective outer pipe 10'. Each of the bottom round holes 51' receives the respective inner pipe 40'. The arm bars 55' are disposed in the grip 50'. The press button 53' is inserted in the slot 52'. The protruded bar 531' is surrounded by a compression spring 54'. Each of the cylinder columns 92' is inserted through the respective circular hole 85' and the respective through hole 41'.

Figure 6:
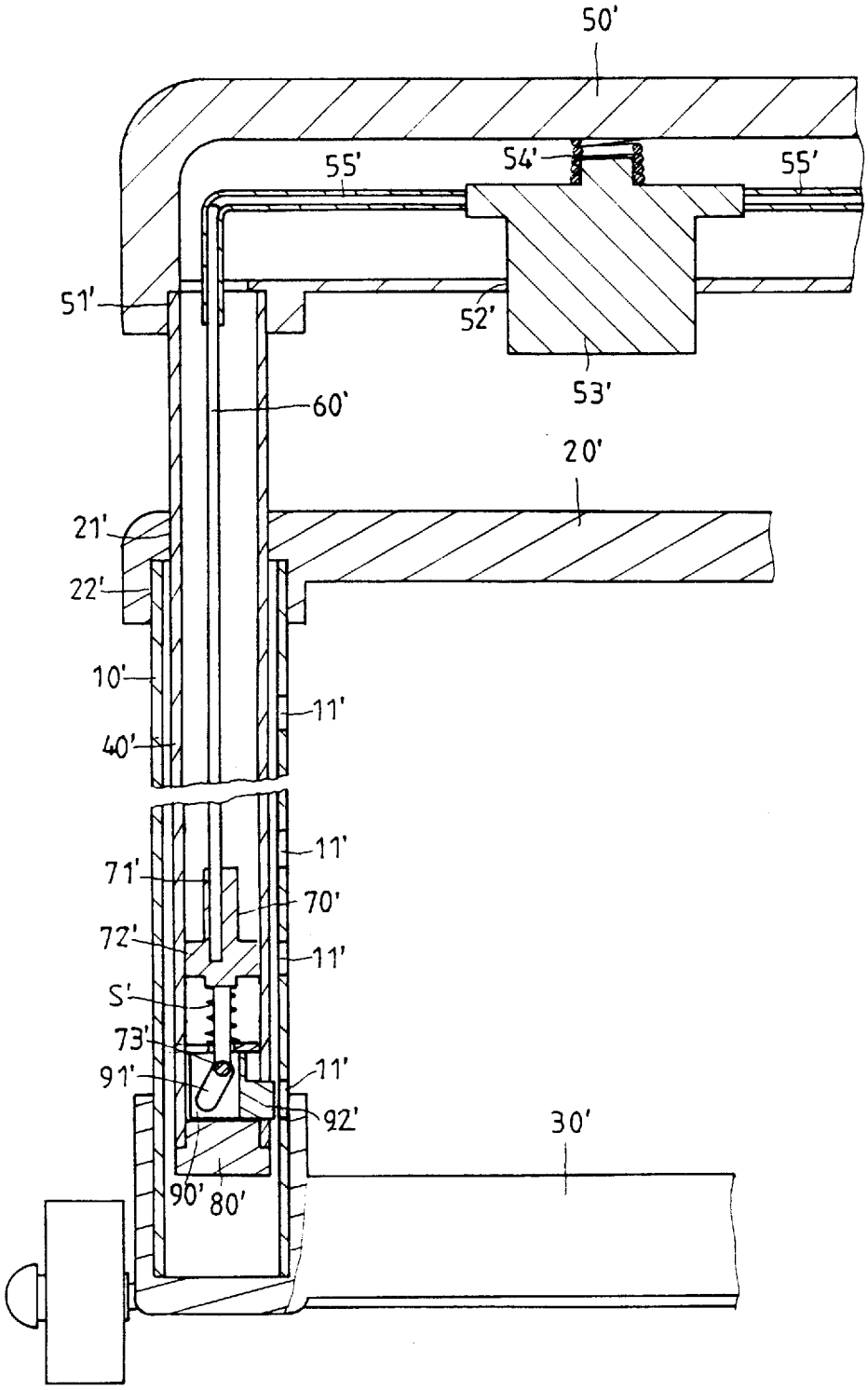
FIG. 6 is a sectional schematic view illustrating an operation of an extensible handle device of a second preferred embodiment while a press button is pressed.

Referring to FIG. 6, the press button 53' is pressed downward. Then the drive blocks 70' move downward. The crossbars 730' move along the lateral grooves 91'. Then the cylinder columns 92' disengage from the positioning holes 11'. Therefore, the user can adjust the length of the extensible handle device.

The invention is not limited to the above embodiments but various modification thereof may be made. Further, various changes in form and detail may be made without departing from the scope of the invention.

I claim:

1. An extensible handle device comprises:

a wheel support seat, two outer pipes, two inner pipes, two base seats, two U-shaped slide seats, two drive blocks, two rods, a press button, a grip, and a positioning seat, the wheel support seat having two hollow sleeves, each of the outer pipes having a plurality of positioning holes, each of the hollow sleeves of said support seat receiving the respective outer pipe, the positioning seat having two square holes and two enlarged holes, each of the square holes communicating with the respective enlarged hole, each of the inner pipes having a through hole, the grip having an upper slot and two bottom round holes, two hollow arm bars connected to the press button, a protruded bar disposed on a bottom of the press button, each of the base seats having a base plate, a main body, a hollow interior formed in the main body, two upper lobes disposed on the main body, a channel defined between the upper lobes, the channel communicating with the hollow interior, and a circular hole formed in the main body, each of the U-shaped slide seats having a cylinder column and two laterally inclined grooves, each of the drive blocks having a middle plate, a hollow pillar disposed on the middle plate, a post disposed on a bottom of the middle plate, and a crossbar disposed on the post, each of the rods inserted one end thereof in the respective hollow arm bar and the other end in the respective hollow pillar, each of the inner pipes inserted in the respective outer pipe, each of the base seats inserted in the respective inner pipe, each of the slide seats inserted in the respective hollow interior, each of the posts of said drive blocks enclosed by a coiled spring, each of the crossbars of said drive blocks inserted in the respective laterally inclined groove, each of the enlarged holes of said positioning seat receiving the respective outer pipe, each of the bottom round holes of said positioning seat receiving the respective inner pipe, the arm bars disposed in the grip, the press button inserted in the slot of said grip, the protruded bar of said grip surrounded by a compression spring, each of the cylinder columns of said slide seats inserted through the respective circular hole and the respective through hole of said base seats and one of the positioning holes of said outer pipes.

* * * * *